US005192959A

United States Patent [19]

Drake et al.

[11] Patent Number: 5,192,959

[45] Date of Patent: Mar. 9, 1993

[54] ALIGNMENT OF PAGEWIDTH BARS

[75] Inventors: Donald J. Drake, Rochester; Ivan Rezanka, Pittsford; Fredrick A. Warner, Fairport, all of N.Y.

[73] Assignee: Xerox Corporation, Stamford, Conn.

[21] Appl. No.: 709,255

[22] Filed: Jun. 3, 1991

[51] Int. Cl.[5] ..... B41J 2/155

[52] U.S. Cl. ..... 346/140 R

[58] Field of Search ..... 346/140 R, 75, 1.1, 346/139 R, 107 R, 139 C; 357/55, 75, 74, 28; 361/397, 400, 401, 417; 437/209; 29/739; 250/239, 578.1; 400/175

[56] References Cited

U.S. PATENT DOCUMENTS

| | | | |
|---|---|---|---|
| 4,463,359 | 7/1984 | Ayata et al. | 346/1.1 |
| 4,690,391 | 9/1987 | Stoffel et al. | 269/21 |
| 4,712,018 | 12/1987 | Stoffel et al. | 250/578 |
| 4,774,530 | 9/1988 | Hawkins | 346/140 R |
| 4,786,357 | 11/1988 | Campanelli et al. | 156/633 |
| 4,814,296 | 3/1989 | Jedlicka et al. | 437/226 |
| 4,822,755 | 4/1989 | Hawkins et al. | 437/227 |
| 4,829,324 | 5/1989 | Drake et al. | 346/140 R |
| 4,851,371 | 7/1989 | Fisher et al. | 437/226 |
| 4,929,300 | 5/1990 | Wegleiter | 156/645 |
| 4,999,077 | 3/1991 | Drake et al. | 156/299 |
| 5,057,854 | 10/1991 | Pond et al. | 346/140 R |
| 5,065,170 | 11/1991 | Rezanka et al. | 346/140 R |

*Primary Examiner*—Benjamin R. Fuller
*Assistant Examiner*—Alrick Bobb
*Attorney, Agent, or Firm*—Duane C. Basch

[57] ABSTRACT

A mechanism for accurately mounting a large area semiconductive device within a larger system is disclosed. The semiconductive device, formed by the linear abutment of semiconductive sub-units divided from a larger semiconductive wafer must be accurately positioned to enable the operation of which it was intended. In one embodiment, the sub-units are thermal ink jet arrays which are abutted to form a pagewidth printhead. The semiconductive device includes a reference plate or substrate having a generally planar surface for mounting an array of functional sub-units thereon. The semiconductive device further includes two or more individual sub-units which are also affixed to the planar surface, thereby forming alignment pads for the assembled semiconductive device. When incorporated into the system, the alignment pads are received by frame members or alignment points to provide positive alignment of the reference plate, and the attached array of sub-units, within the system.

23 Claims, 5 Drawing Sheets

ALIGNMENT OF PAGEWIDTH BARS

BACKGROUND OF THE INVENTION

1. Field of the Invention

This invention relates generally to the fabrication and precision alignment of an array of semiconductive chips, and more particularly to an improved method of aligning such an array when assembled into a printing subsystem.

2. Description of the Prior Art

Fabrication of pagewidth silicon devices from sub-units, such as image sensor arrays having photosites and supporting circuitry integrated onto a silicon substrate and thermal ink jet printheads having an etched silicon structure mated and bonded to a silicon substrate with heating elements and addressing electrodes, impose economically difficult fabricating processes on manufacturers because of the close tolerance requirement for the abutting edges of side-by-side sub-units assembled to produce the pagewidth devices. Furthermore, once such arrays are fabricated to close tolerances, they must be aligned within the larger apparatus and/or with respect to additional arrays within the apparatus. For example, in a multicolor printing system, having a plurality of single color ink jet printhead arrays, the individual arrays must be aligned to produce the desired spacing for respective colored ink dots which are deposited on an output sheet.

Although the standard technique of dicing or scribing and cleaving silicon wafers used by the semiconductive industry produces silicon devices or chips having reasonably controlled dimensions, the microscopic damage occurring to the chip surface during the scribing or dicing operation has effectively precluded the deposition of circuitry or photosites at the chip edge. This has necessitated that a safe distance be maintained. between the last circuit element or photosite and chip edges, if operation of these adjacent photosites or ink jet circuitry is not to be impaired by the presence of either microcracks or silicon chipping along the cleaved or diced edges. Moreover, once the devices or chips are assembled into an array and affixed to a support member, there is no assurance that required dimensional tolerances with respect to positioning of the array will be met.

U.S. Pat. No. 4,851,371 to Fisher et al., discloses a fabrication process for large area semiconductor devices. A pagewidth printing device may be assembled by abutting silicon device sub-units comprising a channel plate and a heater plate which are bonded together. Prior to bonding the channel plate to the heater plate, the channel plate is formed having a trapezoidal shape by etching elongated slots into the plate. After bonding, the heater plates are diced to form kerfs having vertical to inwardly directed sides which enable high tolerance linear abutment.

U.S. Pat. No. 4,822,755 to Hawkins, et al., discloses a method of fabricating large area semiconductor arrays and a method of separating chips formed on a silicon substrate which uses reactive ion etching techniques combined with orientation etching to make integrated chips which may be precisely butted to form a large array. Chip separation is accomplished by dice cutting along a back of the heater plate.

U.S. Pat. No. 4,814,296 to Jedlicka et al, discloses a method of fabricating image sensor dies for use in scanning arrays. V-shaped grooves are etched on the active side of the wafer prior to sawing to prevent cracking and chipping due to sawing.

U.S. Pat. Nos. 4,690,391 and 4,712,018 to Stoffel et al. disclose methods and apparatus for fabricating long, full width scanning arrays by assembling smaller scanning arrays in abutting end-to-end relation. An aligning tool, having predisposed pins, is used to mate a series of smaller arrays in the abutting relationship. FIGS. 3 and 4 of both patents, illustrate the arrays 10, aligning tool 25 and aligning pins 30 thereon which are used to mate with V-shaped aligning grooves in the arrays, thereby enabling alignment of the arrays.

U.S. Pat. No. 4,829,324 to Drake et al., discloses a large array ink jet printhead having two parts, the first having heating elements and addressing electrodes on the surface thereof. The second part containing the liquid ink handling system. The two parts are formed on distinct wafers, with at least the second part being formed on a silicon wafer. The two wafers, having the described features thereon, are aligned and bonded together, then diced into complete printhead sub-units which have abutting side surfaces that are {111} planes for accurate side-by-side assembly.

U.S. Pat. No. 4,929,300 to Wegleiter discloses a process for separating LED chip arrangements fabricated on a substrate wafer so that they can be arrayed in a series with other LED chips. Chips are separated from the wafer by etching a depression in the back side of each chip prior to double saw cutting the chips to produce chips which can be precisely aligned, as illustrated in FIG. 1.

Thermal ink jet printing systems use thermal energy selectively produced by resistors located in capillary filled ink channels near channel terminating nozzles or orifices to momentarily vaporize the ink and form bubbles on demand. Each temporary bubble expels an ink droplet and propels it towards a recording medium. The printing system may be incorporated in a pagewidth type printer, as disclosed in U.S. Pat. No. 4,463,359 to Ayata et al., which teaches printhead having one or more ink filled channels which are replenished by capillary action. A meniscus is formed at each nozzle to prevent ink from weeping therefrom. A resistor or heater is located in each channel upstream from the nozzles. Current pulses representative of data signals are applied to the resistors to momentarily vaporize the ink in contact therewith and form a bubble for each current pulse. Ink droplets are expelled from each nozzle by the growth of the bubbles which cause a quantity of ink to bulge from the nozzle and break off into a droplet at the beginning of the bubble collapse. The current pulses are shaped to prevent the meniscus from breaking up and receding too far into the channels, after each droplet is expelled. Various embodiments of linear arrays of thermal ink jet devices are shown, such as those having staggered linear arrays attached to the top and bottom of a heat sinking substrate for the purpose of obtaining a pagewidth printhead. Such arrangements may also be used for different colored inks to enable multi-colored printing.

Furthermore, U.S. Pat. No. 4,774,530 to Hawkins, discloses the use of an etched thick film insulative layer to provide the flow path between the ink channels and the manifold, and U.S. Pat. No. 4,786,357 to Campanelli et al., discloses the use of an etched thick film insulative layer between mated and bonded substrates. One substrate has a plurality of heating element arrays and addressing electrodes formed on the surface thereof and the other is a silicon wafer having a plurality of etched manifolds, with each manifold having a set of ink channels. The etched thick film layer provides a clearance space above each set of contact pads of the addressing electrodes to enable the removal of the unwanted silicon material of the wafer by dicing without the need for etched recesses therein. The individual printheads are produced subsequently by dicing the substrate having the heating element arrays.

Drop-on-demand thermal ink jet printheads discussed in the above patents are generally fabricated using silicon wafers and processing technology to make multiple small heater plates and channel plates. This works extremely well for small printheads. The fabrication approaches for making either large array or pagewidth thermal ink jet printheads can be divided into basically two broad categories; namely, monolithic approaches in which one or both of the printhead components (heater substrate and channel plate substrate) are a single large array of pagewidth size, or sub-unit approaches in which smaller sub-units are combined to form the large array or pagewidth print bar. For examples of the sub-unit approach, refer to U.S. Pat. No. 4,829,324 to Drake et al. The sub-units approach results in a much higher yield of usable sub-units, if they can be precisely aligned with respect to one another. The assembly of a plurality of sub-units, however, require precise individual registration in both the x-y-z planes as well as the registration of the assembled array in the x-y-z planes. The alignment problems for these assembled arrays presents quite a formidable task, and one which has, up to this point, required expensive alignment mechanisms and techniques.

SUMMARY OF THE INVENTION

The present invention is an alignment apparatus used to align a large area semiconductive device, such as a pagewidth printhead or image sensor, with respect to a target. The semiconductive device is formed by the linear alignment of sub-units, where each sub-unit has a planar semiconductive substrate with an array of active elements and supporting circuitry on its surface. Moreover, the sub-units are produced by dividing them from a larger semiconductive wafer. The apparatus includes a reference plate, a plurality of functional sub-units affixed to the reference plate to form a linear array of sub-units. The apparatus also includes at least two locating sub-units which are affixed to the reference plate to form alignment pads. These alignment pads are used to align the reference plate and attached array in at least one dimension with respect to the target.

The present invention may be incorporated within a thermal ink jet printer, which would include a frame, at least one ink manifold adapted to supply printing ink, and at least one pagewidth printhead. As previously described, the pagewidth printhead would include a reference plate, a linear array of ink jet sub-units affixed to the reference plate, and a plurality of alignment sub-units affixed on opposite ends of the planar surface of said reference plate. Moreover, each ink jet sub-unit has a planar semiconductive substrate with at least one ink jet nozzle and supporting circuitry on its surface. In addition, the ink jet sub-units are sealingly aligned with the ink manifold to enable ink to flow from the manifold to the nozzles. The ink jet printer would also include alignment or reference points for engaging the alignment sub-units and thereby aligning the pagewidth printhead with respect to the frame. In operation, a sheet would be moved past the ink jet nozzles, while selectively activating the nozzles to produce a printed image on the sheet.

The present invention will be described in the environment of a printing subsystem, wherein a printhead is assembled from aligned and mated silicon heating element plates and silicon ink flow directing channel plates, though other large array devices assembled from silicon sub-units, such as image sensors and LED bars, are equally improved by this invention. Furthermore, other semiconductive material such as, for example, gallium arsenide may be used instead of silicon.

Briefly, the heating element plates, each containing a linear array of heating elements and addressing electrodes, are bonded to channel plates having ink channels formed therein to produce complete printhead sub-units. The sub-units, are obtained by a sectioning operation performed on a wafer having a plurality of sets of heating elements and associated addressing electrodes patterned on one surface thereof, said surface also having mating channel plates bonded thereto. The sides of the heating element plate, which are to be linearly abutted together to form the pagewidth printhead, are sectioned by cutting along a cutting line with an angled dicing blade to produce a heating element side that slopes inwardly from the top surface. After the cut, the wafer is rotated 180° and a parallel second cut is made with the blade maintained at the same predetermined angle with respect to the wafer, so that the sides of the adjacent heating element plates also have inwardly sloping sides. Thus, each heating element plate has inwardly sloping side walls on the opposite sides which are to be abutted, and results in a heating element plate having a larger top surface than its bottom surface. The top surface is where the heating elements and addressing electrodes reside, and these top surfaces are substantially contiguous when abutted together, while the opposite bottom surfaces are separated from each other.

The foregoing features will become apparent from a reading of the following specification in conjunction with the drawings, wherein like parts have the same index numerals.

DESCRIPTION OF THE PREFERRED EMBODIMENT

Figure 1:
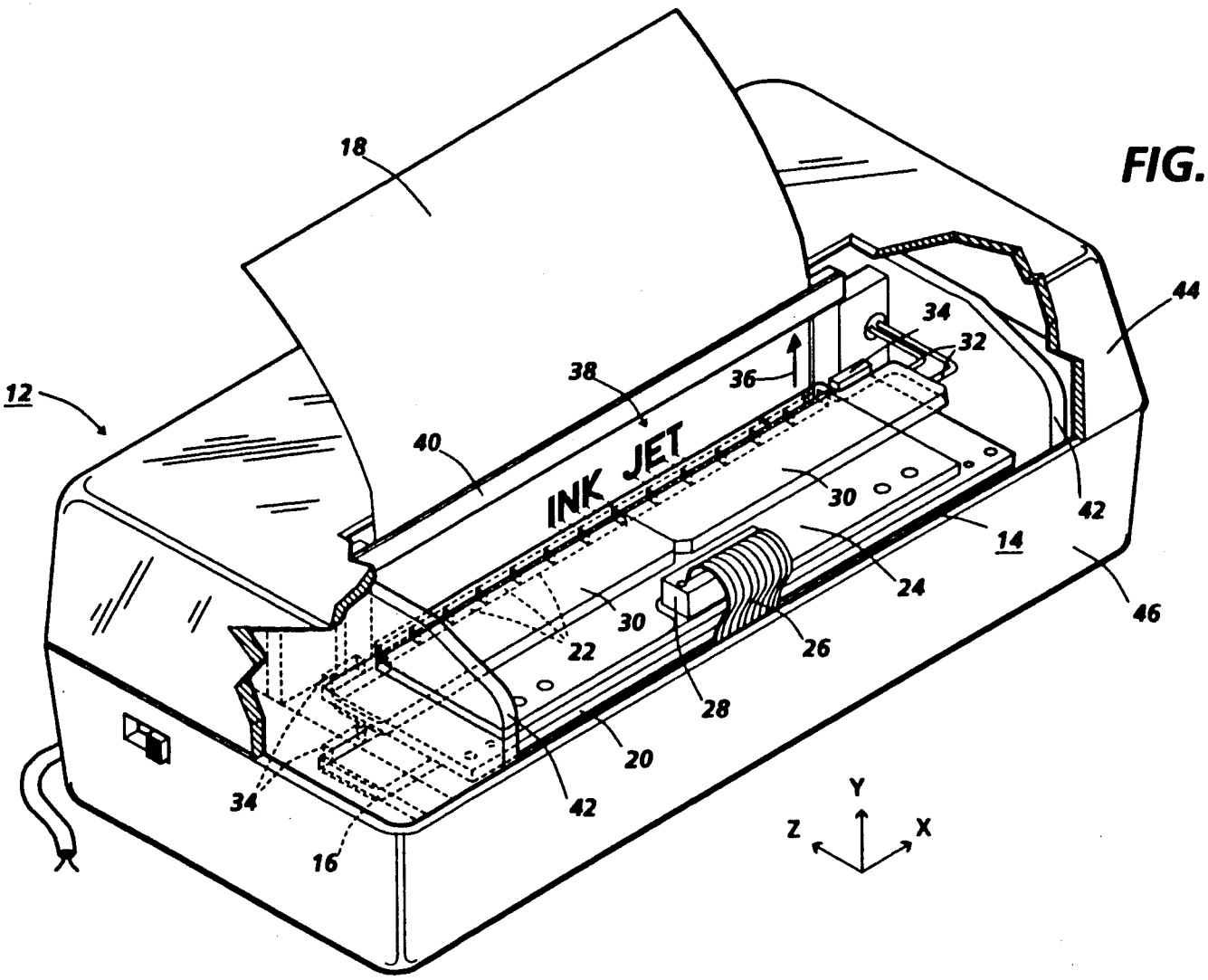
FIG. 1 is a cutaway view of a printer utilizing a pair of pagewidth printheads positioned in accordance with the present invention.

In FIG. 1, ink jet printer 12 is illustrated with pagewidth printheads 14 and 16, disposed therein to produce printed output on sheet 18. Printheads 14 and 16 each comprise a substrate 20, upon which an array of printhead sub-units 22 are affixed in abutted fashion. Alternatively, individual sub-units 22 may be spaced apart from one another by a distance approximately equal to the length of a single sub-unit. This is commonly known as staggered array, where pagewidth printing is enabled by the use of 2 or more staggered arrays. In one embodiment, sub-units 22 may be similar in construction to those sub-units described in U.S. Pat. No. 4,851,371 to Fisher et al., the relevant portions of which are hereby incorporated by reference. The forward facing edges of sub-units 22 are maintained in close proximity to the surface of sheet 18. Also affixed to substrate 20, at a position behind the abutted sub-unit array, is printed wiring board (PWB) 24. PWB 24 contains the circuitry required to interface and drive the individual ink jets which are exposed on the front face of sub-units 22. While not shown, PWB 24 is connected to individual contacts contained on the sub-units via a commonly known wire bonding technique. The data required to drive the individual ink jets of the printhead sub-units is supplied from an external system by a standard printer interface, modified and/or buffered by control logic (not shown) within the printer, and transferred to the printheads via ribbon cable 26 and pin-type connector 28.

Figure 4:
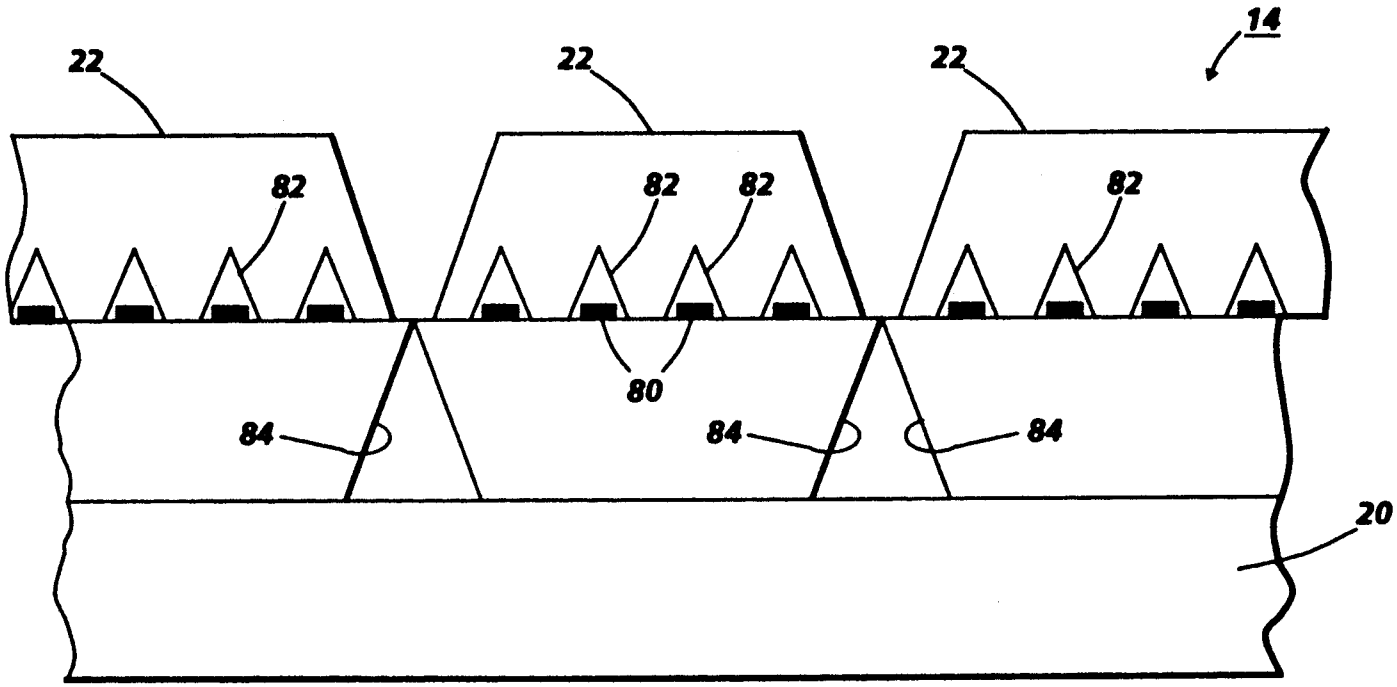
FIG. 4 is an enlarged, partially shown, elevational view of the active portion of the pagewidth printhead of FIG. 1.

Ink is supplied to the individual ink jet nozzles 82 of FIG. 4, via internal channels (not shown), which are connected to through vias or apertures (not shown) in the upper surface of printhead sub-units 22. Further description of such an arrangement may be found in U.S. Pat. No. 4,829,324 to Drake et al., the relevant portions of which are hereby incorporated by reference. Ink is supplied to the through vias by ink manifolds 30 which are, in turn, supplied from an ink reservoir (not shown) through ink supply hoses 32. Alternatively, ink may be supplied to the ink jet nozzles 82 (through vias) by any known reservior/manifold or cartridge technique suitable for sealing mating with the upper surface of the sub-units 22. Also affixed to the surface of substrate 20 are locating or alignment pads 34 which are used to accurately position the array within printer 12. The location of pagewidth printheads 14 and 16 is particularly important to accurately position the abutted printhead sub-units comprising each array. The relative positions of the arrays becomes particularly important in printers employing more than a single pagewidth printhead. Such a printer would be able to produce multicolored output, which requires accurate placement of the ink droplets from each printhead relative to one another, in order to achieve the desired output quality.

As further illustrated in FIG. 1, sheet 18 is fed in the direction of arrow 36 as ink droplets are ejected from the front face of sub-units 22 to produce output image 38 thereon. The paper is fed by conventional paper feeding mechanisms (not shown), and is maintained in close proximity to the front face of the printheads by one or more paper guides 40. The spacing between the front face of the printhead sub-units where the ink jet nozzles are found and the surface of the paper sheet, commonly referred to as the z-direction, is important to control the position and size of the ink droplets ejected from the individual nozzles. Furthermore, the spacing between two parallel and adjacent pagewidth printheads, for example printheads 14 and 16, must be maintained within close tolerance.

As an example of the close tolerances required for a two color, 300 spot per inch (spi) printer, the spacing between the printhead arrays, the y-direction, should be maintained within about ±50 μm. That is, the distance separating the parallel linear arrays of ink jet nozzles should be controlled to be within an established tolerance of about ±50 μm. In a similar system operating at 600 spi, the tolerance for the distance separating the printheads is approximately half, or ±25 μm. For a single color printer, one which simultaneously uses both printheads for the same output color to enable a higher paper velocity, the tolerance in a 300 spi system must be maintained to within about ±12 μm. With respect to the vertical alignment of corresponding ink jet nozzles on adjacent arrays, x-direction, similar tolerances must be met. In other words, the end nozzles of two parallel, adjacent pagewidth printheads in a 300 spi color printer should be within about ±50 μm in vertical alignment with one another.

Printer 12 also includes rigid frame members 42 which provide mechanisms, such as reference points, for receiving alignment pads 34 and for holding the pagewidth printheads 14 and 16 in alignment during operation of the printer. As the frames and mounting mechanisms incorporated therein generally have some associated dimensional tolerances, it is even more important to produce the pagewidth printheads and associated alignment pads to more exacting tolerances. Finally, the previously described elements of printer 12 are generally enclosed within upper and lower covers, 44 and 46 respectively, upper cover 44 having an elongated opening in the center of its upper surface to enable sheet 18 to exit the printer.

Figure 2:
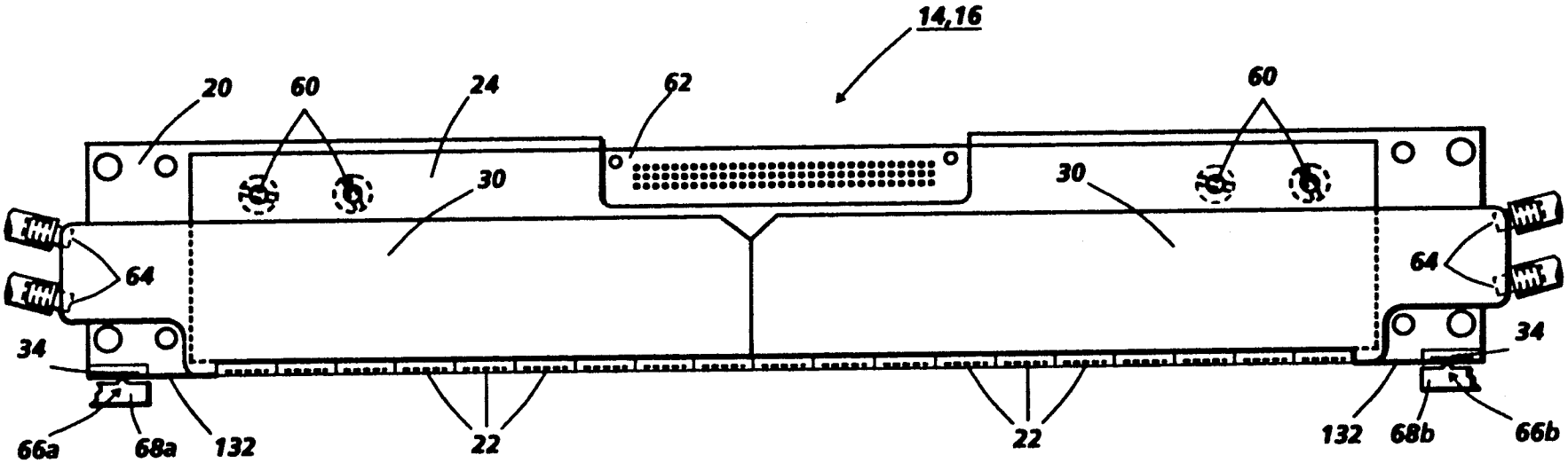
FIG. 2 is a plan view of one of the pagewidth printheads used in the printer of FIG. 1.

Referring now to FIG. 2, which illustrates one of the two similar pagewidth printheads 14 or 16, the printhead is built upon rigid substrate 20. Along the front face of substrate 20, a linear array of ink jet printing sub-units 22 are positioned with their exposed ink nozzles (not shown) facing outward. The array of ink jet printing sub-units is permanently affixed to the substrate by a thin layer of epoxy material which is sandwiched between the sub-units and the substrate. Behind this array of sub-units lies PWB 24 which is fastened to substrate 20 by screws 60. Alternatively, PWB 24 may be detachably fastened to substrate 20 with clips or other suitable fastening mechanism. PWB 24 is shown in FIG. 2 with a male type pin connector 62 suitable for use with connector 28 of FIG. 1. Next, ink manifolds 30 are placed over the upper surface of printing sub-units 22 and a portion of PWB 24. The ink manifolds have outlets (not shown) in their underside to allow the flow of ink from the aligned outlets into vias (not shown) in the upper surface of the printing sub-units. In operation, ink is supplied to the manifolds by hoses which are connected to couplings 64, the ink being supplied from a larger reservoir (not shown) within the printer.

The pagewidth printhead also includes a pair of alignment pads 34 for positioning the printhead within the printer. In one embodiment, the alignment pads are provided by a pair of functional or non-functional sub-units which are affixed to the outer ends of the substrate at about the same time, and in the same manner as the printing sub-units. By utilizing non-functional sub-units, ideally sub-units produced from the same silicon wafer as the functional printing sub-units, the alignment pads will be representative of the dimensions and tolerances of the printing sub-units which are used to produce the array. There is generally no additional cost for using non-functional sub-units, as typical semiconductor industry yields for such devices is on the order of seventy percent, thus assuring ample supply of the non-functional sub-units. However, as mentioned, functional sub-units may be used in these non-operational positions. By affixing the functional or non-functional sub-units on the substrate in the same manner and at approximately the same time as the printing sub-units are affixed to the substrate, alignment pads 34 may be used to accurately locate the assembled pagewidth printhead. Alignment points 66*a,b*, which are rigidly connected to frame 42 of printer 12 (FIG. 1), contact the front surface of pads 34. More specifically, alignment points 66*a,b* are integrated with locating means 68*a* and 68*b*, respectively. Locating means 68*a* and 68*b* extend from, or are machined into, frame 42 to provide rigid mounts for alignment points 66*a* and 66*b*. Furthermore, the position of alignment points 66*a,b* with respect to one another and with respect to the surface of sheet 18 (FIG. 1) must be accurately maintained to assure proper placement of the printhead in the z-direction. Once the pagewidth printhead is installed in the printer, alignment pads 34 and alignment points 66*a,b* work in conjunction to control the position of the printhead in the z-direction and with respect to the surface of the paper sheet which passes the array of printing sub-units 22. This effectively controls the distance over which the ink droplets must travel upon being expelled from the ink jets.

Figure 3B:
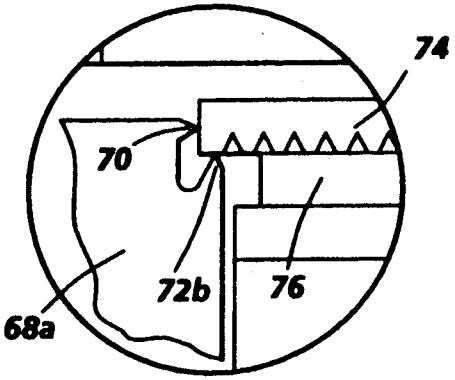
FIGS. 3A, 3B and 3C are enlarged elevational views of one end of the pagewidth printhead, illustrating the alignment mechanisms used to position the printhead within the printer of FIG. 1.
Figure 3C:
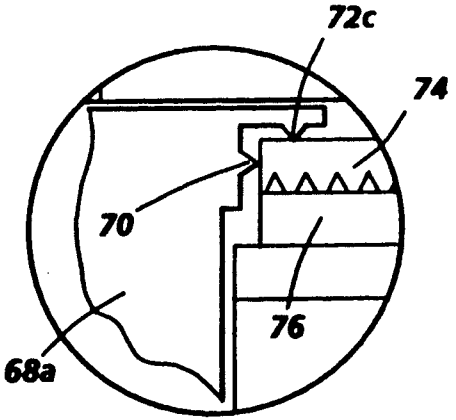
Figure 3A:
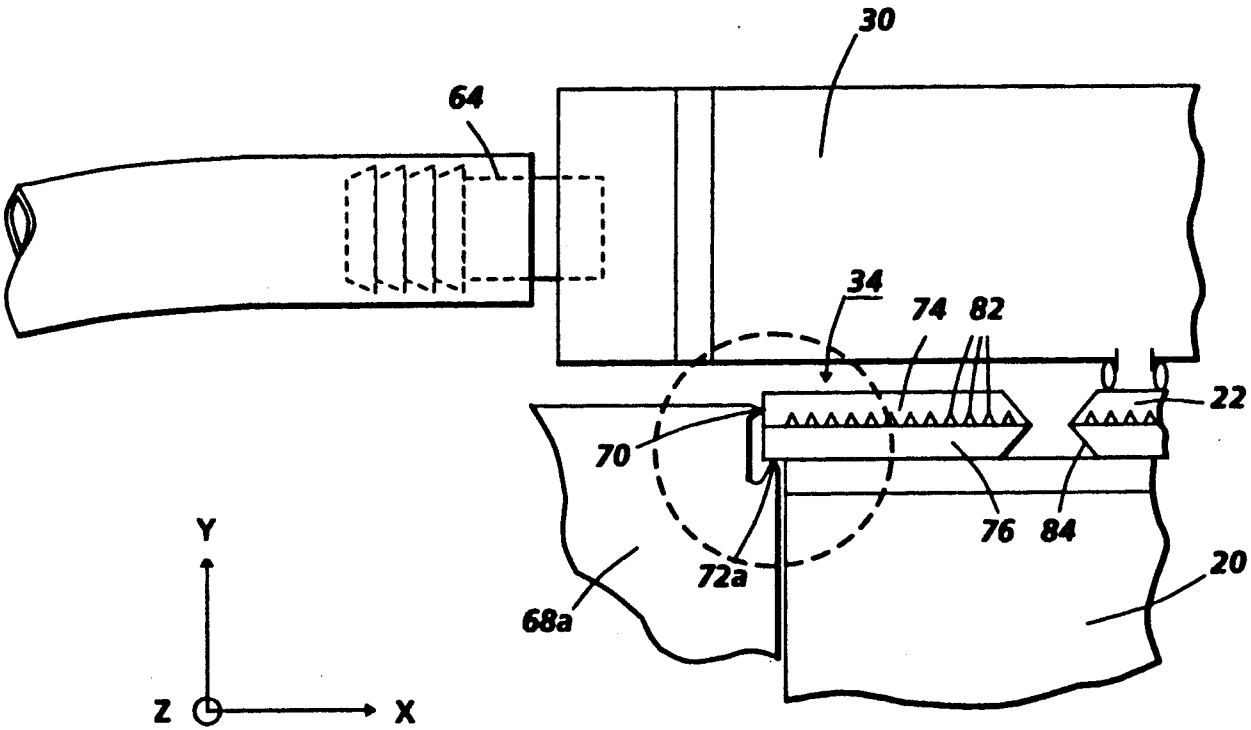

Referring now to FIG. 3A, which illustrates an end portion of the front face of assembled pagewidth printhead 14 or 16, substrate 20 has an alignment pad 34 placed at two or more locations thereon. While only one end of the pagewidth printhead is illustrated in FIG. 3A, it should be understood that the opposite end of the printhead would be similar in design and function. Above and behind alignment pad 34 lies ink manifold 30 as previously described with respect to FIGS. 1 and 2. Referring also to FIG. 4, which is an enlarged view of another portion of the pagewidth printhead 14 or 16, showing an operational portion of the printing array as assembled from printhead sub-units 22. Schematically illustrated heating elements 80 are shown in each channel through nozzles 82. The confronting walls 84 of heating element plates 86 are produced, for example, by angled dicing of the silicon wafer and enable the close tolerance abutting of the printhead sub-units 22 as described by U.S. Pat. No. 4,851,371 to Fisher et al.. As previously described, pagewidth printheads 14 and 16 are assembled on support substrate 20, which may also act as a heat sink for the attached printhead sub-units.

When two or more pagewidth printheads are incorporated into a printer, as illustrated in FIG. 1, it is imperative that the position of the nozzles be accurately controlled relative to each other. As previously described, the relative spacing of a nozzle on one printhead must be controlled with respect to the corresponding nozzles on the other printheads within the printer. With alignment pads 34 and printhead sub-units 22 commonly affixed to substrate 20 under close dimensional tolerance, it is possible to position the printhead sub-units 22 by accurately controlling the position of alignment pads 34. Alternatively, it may be possible to affix alignment pads 34 to substrate under less critical dimensional tolerances, and subsequently dice or trim the outer or exposed ends of pads 34 to the desired dimensional tolerance.

FIGS. 3A, 3B, and 3C illustrate the use of locating means 68*a*, which further incorporates alignment points 70 and 72 in addition to alignment point 66*a* of FIG. 2, for positioning pagewidth printheads 14 and 16 within the printer. As previously described, locating means 68*a* is rigidly connected to, or machined into, frame 42 of FIG. 1, to provide an accurate and fixed location for the alignment points. Installing a pagewidth printhead (14 or 16) within printer 12 is thus enabled by simply sliding the printhead into the recesses formed by the locating means and alignment points, and securing the printhead in a manner to assure that the alignment points are in contact with the alignment pads. Generally, the pagewidth printheads would be forceably held in contact with the alignment points, via spring loading or other commonly known method, to assure accurate positioning of the printheads at all times.

In the embodiment illustrated in FIG. 3A, the x-y position of the printhead is controlled by alignment of the outer and lower edges of the alignment pad. Generally, outer or x-direction alignment point 70 would be in contact with the channel plate 74 or upper portion of the sub-unit, while the lower or vertical alignment point 72*a* would be in contact with the heater plate 76 of the device. Locating pagewidth printheads 14 and 16 in this manner enables the relative position of the ink jet nozzles to be maintained within about $\pm 14$ μm in the y-direction and within less than $\pm 12$ μm in the x-direction. The variability results primarily from the variation in thickness of heater plate 76. Alternatively, the non-functional device used for alignment pad 34 may be modified to expose the lower edge of channel plate 76 as illustrated in FIG. 3B. Modification of the non-functional sub-unit enables the accurate positioning of the linear array of ink jet nozzles, by locating the printhead with respect to channel plate 74 using contact point 72*b*, thereby removing the variability in position due to heater plate 76. Yet another method of mounting is illustrated in FIG. 3C, wherein an unmodified, non-functional sub-unit is used to align the pagewidth printhead. Specifically, side and top surface channel plate references are used to position the printhead using alignment points 70 and 72*c*, respectively. Use of the alignment approach illustrated in FIG. 3 would result in a $\pm 14$ μm variation in the y-direction, due primarily to the variation in thickness of the channel plate.

Figure 5:
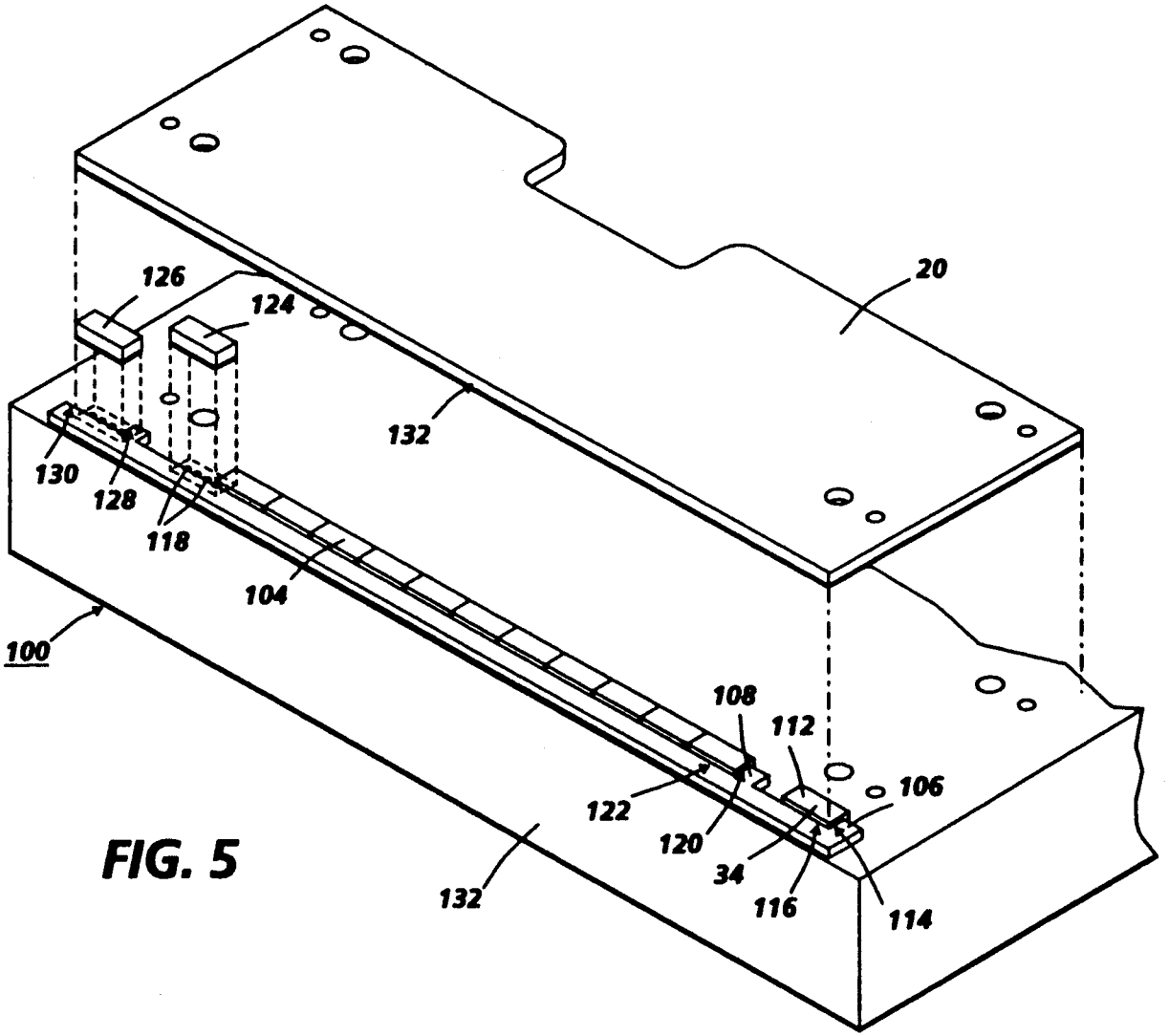
FIG. 5 is a perspective view of a mechanism used to align the individual semiconductive devices of the pagewidth printhead during the process of assembling the pagewidth printhead.

Referring now to FIG. 5, which illustrates the assembly of the pagewidth printhead of the present invention, chip alignment jig 100 is first used to accurately locate the sub-units, printing and non-functional, with respect to one another. Alignment jig 100 generally comprises a flat, rigid base plate 102, which has a raised reference edge 104 on the upper surface thereof. The reference edge also has a series of tabs 106, 108, and 110 extending from one side in the plane of the reference edge. Tabs 106, 108, and 110 provide surfaces to which the sub-units may be abutted. As illustrated in the figure, a plurality of sub-units 22 are abutted along the central portion of reference edge 104, between tabs 108 and 110. Furthermore, non-functional sub-units are positioned against the outer tabs, 106 and 110, to produce alignment pads 34.

Assembly of the printhead proceeds first with the placement of an outer alignment or locating pad, 112 in abutting contact with edges 114 and 116. Pad 112 is placed on the surface of plate 102 in an upside-down orientation with respect to the operating orientation. A non-functional semiconductive sub-unit is used for the pad. Once placed in the appropriate position, pad 112 may be temporarily maintained in its place by the application of a vacuum to the underside of the sub-unit. As shown at the opposite end of plate 102, vacuum orifices 118 underlay each of the sub-units and may be connected to a negative pressure source (not shown) on a selective sub-unit by sub-unit basis. In general, application of the vacuum force holds the sub-units in their respective positions during the placement of subsequent sub-units of the array.

Continuing with the assembly, the first functional or printing sub-unit is then placed in abutting contact with tab 108 and reference edge 104, along edges 120 and 122, respectively. Again, the sub-unit may be held in place with the selective application of a negative pressure to the underside of the sub-unit. Likewise, additional sub-units 22 are positioned in abutting contact with edge 122 and the exposed end of the previously placed sub-unit. This process is repeated until the last sub-unit of the array, sub-unit 124, is placed in position. Subsequently, the second alignment pad is provided by the placement of non-functional sub-unit 126 in abutting contact with edges 128 and 130 in a manner similar to that previously described with respect to pad 112.

Once all the sub-units, both functional and non-functional have been placed along the reference edge, a thin bead or layer of epoxy resin is applied prior to assembling the sub-units and substrate 20. The resin is applied to the underside of substrate 20 near edge 132 so that when placed in contact with the sub-units the resin will contact the top facing surface of the sub-units. Alternatively, the resin may be applied to the top facing surface of the sub-units. After the resin has been applied, substrate 20 is brought into contact with the sub-units. Using a thixotropic die bond epoxy, the sub-units become sufficiently "tacked" to substrate 20 to prevent movement. Subsequently, the epoxy resin is cured in an oven to permanently affix sub-units 22 to substrate 20. Once the resin is cured, the vacuum applied to the chips is released and the substrate is removed with the sub-units permanently affixed thereto. Subsequently, the substrate is inverted in order to complete the assembly of the printhead with the remaining elements, PWB 24, ink manifold 30 and screws 60, as illustrated in FIG. 2.

In an alternative assembly method, alignment or locating sub-units 112 and 126 would be placed at approximately the same positions indicated in FIG. 5, however, the sub-units would be displaced outwardly along the registration edge. More specifically, alignment sub-units 112 and 126 would be spaced farther from the abutted printing array sub-units 22, thus overhanging the edge of substrate 20 by a greater amount than indicated in FIG. 5. In other words, tabs 106 and 110, which are used to control the spacing of alignment sub-units 112 and 126, respectively, would be spaced further from the center of the reference edge 104. Positioning sub-units 112 and 126 in this manner would provide some excess exposure of the sub-units beyond the edge of substrate 20, and would enable subsequent trimming or dicing of the exposed ends of the alignment sub-units. Highly accurate dicing of alignment sub-units 112 and 126 in this manner would produce accurate edges for positioning the pagewidth printheads in the x-direction as previously illustrated in FIGS. 3A, 3B, and 3C.

While the present invention has been described with respect to the accurate positioning of pagewidth thermal ink jet printheads, it is certainly applicable to the positioning of pagewidth image scanning arrays or LED bars. For example, an array as disclosed in U.S. Pat. No. 4,712,018 to Stoffel et al. might be employed in a multiple array scanning system to scan color images, where each pagewidth scanning array was sensitive to a certain color spectrum. Moreover, many modifications and variations are apparent from the foregoing description of the invention and all such modifications and variations are intended to be within the scope of the present invention.

We claim:

1. An apparatus having a large area semiconductive device which is positioned to operate with respect to a target, said semiconductive device being formed by linear placement of functional sub-units, each functional sub-unit having a planar semiconductive substrate with an array of active elements, and supporting circuitry on a first surface thereof, said functional sub-units having been divided from a larger semiconductive wafer, comprising:

a reference plate;

a plurality of said functional sub-units affixed to said reference plate to form a linear array of sub-units thereon;

at least two locating sub-units affixed on opposite ends of said reference plate to form alignment pads thereon; and means, located within the apparatus, for receiving said alignment pads in order to align said reference plate and the affixed linear array of sub-units in at least one dimension with respect to the target wherein the first surface of the functional sub-units is unobstructed by the receiving means.

2. The apparatus of claim 1, wherein said plurality of sub-units affixed to said reference plate form an array of abutted sub-units.

3. The apparatus of claim 1, wherein said plurality of sub-units affixed to said reference plate from an array of staggered sub-units.

4. The apparatus of claim 1, wherein the sub-units are smaller linear arrays of semiconductive elements from the group consisting of:

thermal ink jet elements;

light emitting elements; and light sensitive elements.

5. The apparatus of claim 1, wherein said sub-units are thermally activated ink jet sub-units and wherein the semiconductive device further comprises:

an ink manifold adapted to supply ink to the ink jet sub-units; and means for electrically interconnecting the ink jet sub-units to an external system.

6. The apparatus of claim 1, wherein said locating sub-units are semiconductively non-functional sub-units.

7. The apparatus of claim 6, wherein said locating sub-units are spaced away from said linear array of abutted sub-units.

8. A thermal ink jet printer, comprising:

a frame;

at least one ink manifold adapted to supply printing ink, said manifold having outlets therein to enable ink to flow from said manifold;

a pagewidth printhead, including; a reference plate, a linear array of jet sub-units disposed on said reference plate, each ink jet sub-unit having a semiconductive substrate with at least one ink jet nozzle and supporting circuitry, said ink jet sub-units being sealingly aligned with said manifold outlets to enable ink to flow from said manifold to said nozzles, and a plurality of alignment sub-units affixed on opposite ends of said reference plate;

locating means for aligning said pagewidth printhead, on said frame;

means for moving a sheet and said ink jet nozzles relative to one another; and means for selectively activating said nozzles to produce a printed image on the sheet.

9. The thermal ink jet printer of claim 8, wherein said linear array of ink jet sub-units disposed on said reference plate form a linear array of abutted sub-units.

10. The thermal ink jet printer of claim 8, wherein said linear array of ink jet sub-units disposed on said reference plate form a linear array of staggered sub-units.

11. The thermal ink jet printer of claim 8, wherein said locating means includes alignment points which engage said alignment sub-units, so that said reference plate and attached array of ink jet sub-units are aligned with respect to said frame.

12. The thermal ink jet printer of claim 8, wherein said alignment sub-units are semiconductively non-functional sub-units.

13. The thermal ink jet printer of claim 12, wherein said alignment sub-units are spaced apart from said linear array of ink jet sub-units.

14. The thermal ink jet printer of claim 13, wherein said ink jet sub-units and at least one of said alignment sub-units are produced from the same semiconductive wafer.

15. A thermal ink jet printer, comprising:

a frame;

at least one ink manifold adapted to supply printing ink, said manifold having outlets therein to enable ink to flow from said manifold;

at least two pagewidth printheads, each of said pagewidth printheads including a reference plate, a linear array of ink jet sub-units disposed on said reference plate, each ink jet sub-unit having a planar semiconductive substrate with at least one ink jet nozzle and supporting circuitry, said ink jet sub-units having one or more apertures sealingly aligned with said manifold outlets to enable ink to flow from said manifold to said nozzles, and at least two alignment sub-units affixed on opposite ends of said reference plate;

locating means, for receiving said alignment sub-units in order to align said pagewidth printheads with said frame;

means for moving a sheet and said pagewidth printheads relative to one another; and means for selectively activating said nozzles of said pagewidth printheads to produce a printed image on the sheet.

16. The thermal ink jet printer of claim 15, wherein said locating means include alignment points which engage said alignment sub-units so that each said reference plate and attached arrays of ink jet sub-units are aligned with respect to said frame.

17. The thermal ink jet printer of claim 15, wherein said linear array of ink printer sub-units is an abutted array, so that each of said page width printheads is capable of printing in a continuous fashion across a page.

18. The thermal ink jet printer of claim 15, wherein said sub-units which form said linear array of ink jet sub-units are spaced apart from one another to form a staggered array, so that two or more of said pagewidth printheads working in conjunction with one another, are requried to enable printing in a continuous fashion across a page.

19. The thermal ink jet printer of claim 15, wherein said alignment sub-units are semiconductively non-functional sub-units.

20. The thermal ink jet printer of claim 15, wherein said alignment sub-units are spaced away from said linear array of abutted ink jet sub-units.

21. The thermal ink jet printer of claim 16, wherein said ink jet sub-units and said alignment sub-units are produced from the same semiconductive wafer.

22. The thermal ink jet printer of claim 15, wherein said pagewidth printheads print with the same color ink, thereby enabling the sheet to be moved at a faster speed while passing said pagewidth printheads.

23. The thermal ink jet printer of claim 15, wherein said pagewidth printheads each print with a different color ink, thereby providing the capability for multi-color printing on the sheet.

* * * * *